US005871891A

United States Patent [19]

Evans et al.

[11] Patent Number: 5,871,891

[45] Date of Patent: Feb. 16, 1999

[54] PROCESSING BOTH LOW AND HIGH SILVER PHOTOGRAPHIC MATERIALS IN A SEQUENTIAL MANNER IN A SINGLE PROCSSOR

[75] Inventors: Gareth B. Evans, Potten End; Peter J. Twist, Lee Common, both of United Kingdom

[73] Assignee: Eastman Kodak Company, Rochester, N.Y.

[21] Appl. No.: 969,988

[22] Filed: Nov. 13, 1997

[30] Foreign Application Priority Data

Nov. 13, 1996 [GB] United Kingdom ..... 9623565

[51] Int. Cl.[6] ..... G03C 7/407

[52] U.S. Cl. ..... 430/434; 430/373; 430/399; 430/414; 430/943

[58] Field of Search ..... 430/373, 399, 430/414, 434, 943

[56] References Cited

U.S. PATENT DOCUMENTS 4,219,615 8/1980 Sakai ..... 430/373

5,006,439 4/1991 Wernicke et al. ..... 430/379

FOREIGN PATENT DOCUMENTS 0 600 564 A1 6/1994 European Pat. Off. .

91/12567 8/1991 WIPO .

*Primary Examiner*—Hoa Van Le

*Attorney, Agent, or Firm*—J. Lanny Tucker

[57] ABSTRACT

A processing method can be used to develop sequentially both low silver and relatively high silver photographic materials in the same processor. The method includes a development step for each type of material, in any order, with a developer solution adapted for both development steps. When the lower silver photographic materials are developed, the developer solution also contains an oxidizing agent to render it a redox developer/amplifier solution. The oxidizing agent is removed or inactivated when the relatively high silver photographic materials are processed with the same developer solution.

19 Claims, No Drawings

PROCESSING BOTH LOW AND HIGH SILVER PHOTOGRAPHIC MATERIALS IN A SEQUENTIAL MANNER IN A SINGLE PROCSSOR

FIELD OF THE INVENTION

This invention relates to a process for the sequential development of both low and high silver photographic materials in the same processor.

BACKGROUND OF THE INVENTION

Redox amplification processes have been described, for example in British Specifications Nos. 1,268,126; 1,399,481; 1,403,418; and 1,560,572. In such processes, color materials are developed to produce a silver image (which may contain only small amounts of silver) and treated with a redox amplifying solution (or a combined developer/amplifier) to form a dye image.

The developer/amplifier solution generally contains a color developing agent and an oxidizing agent which will oxidize the color developing agent in the presence of the silver image which acts as a catalyst.

Oxidized color developer reacts with a color coupler to form the dye image. The amount of dye formed depends on the time of treatment or the availability of the color coupler and is less dependent on the amount of silver in the image than is the case in conventional color development processes.

Examples of suitable oxidizing agents include peroxy compounds including hydrogen peroxide and compounds which provide hydrogen peroxide, e.g., addition compounds of hydrogen peroxide such as perborates and addition compounds of hydrogen peroxide with urea. Other oxidizing agents include cobalt (III) complexes including cobalt hexammine complexes; and periodates. Mixtures of such compounds can also be used.

Such redox amplification processes are designed for processing low silver color papers, for example, those having about 200 mg/m$^2$ or less of silver and generally cannot be used to process conventional color papers that typically contain from 500 to 700 mg/M$^2$ because gross overamplification would occur. If it is necessary to process both lower silver and conventional higher silver photographic recording materials in the same processing apparatus, it is currently not possible to avoid the expense and inconvenience of having to empty and recharge the processor with different processing solutions (specifically different developers).

The present invention provides a solution to these problems.

SUMMARY OF THE INVENTION

According to the present invention there is provided a process for the sequential color development, in the same processor, of an imagewise exposed low silver photographic material and an imagewise exposed relatively high silver photographic material, the method comprising, in any order:

(i) developing the low silver photographic material in a developer solution comprising:

a color developing agent, and a buffering agent, and having a pH in the range of from 10 to 12.5, and (ii) developing the relatively high silver photographic material with the developer solution, provided that when step (i) is carried out, the developer solution further comprises an oxidizing agent to make the developer solution a redox developer/amplifier solution, and further provided that when step (i) is carried out first, the developer solution is treated to remove the oxidizing agent, and when step (ii) is carried out first, the oxidizing agent is added to the developer solution prior to step (i).

The method of the present invention enables a user to sequentially process low silver and conventional higher silver photographic materials without the necessity of emptying and recharging the processor equipment. Moreover, it is not critical as to which type of photographic material is processed first in the method.

DETAILED DESCRIPTION OF THE INVENTION

In the practice of this invention, the color developing agent may be any of those known in the art, for example, p-phenylene diamines, such as 4-amino N,N-diethylaniline hydrochloride, 4-amino-3-methyl-N,N-diethylaniline hydrochloride, 4-amino-3-methyl-N-ethyl-N-(β-(methanesulfonamido) ethyl)aniline sesquisulfate hydrate, 4-amino-3-methyl-N-ethyl-N-(β-hydroxyethyl)aniline sulfate, 4-amino-3-β-(methanesulfonamido)ethyl-N,N-diethyl aniline hydrochloride and 4-amino-N-ethyl-N-(2-methoxyethyl)-m-toluidene di-p-toluene sulfonic acid.

Useful oxidizing agents are preferably hydrogen peroxide or a compound that generates hydrogen peroxide. It is generally present in amounts from about 0.5 to about 30 ml/l, and preferably from about 5 to about 20 ml/l (as 30% w/w aqueous solution).

The developer solution can also include a suitable antioxidant, such as hydroxylamine or a salt thereof such as hydroxylamine chloride, phosphate or, preferably, a sulfate.

Derivatives of hydroxylamine, such as N-substituted hydroxylamines, including mono- or disubstituted hydroxylamines, may be employed as well, or in admixture with hydroxylamine.

Suitable substituents for a hydroxylamine include monovalent organic groups containing not more than 12 carbon atoms. Suitable groups are alkyl or aryl groups which may be further substituted, for example, with sulfo, hydroxy, sulfonamido, carbonamido, or carboxy groups. Lower alkyl groups, for example, containing from 1 to 6 carbon atoms are particularly suitable.

Concentration ranges for the antioxidant are from about 0.01 to about 20 g/l and preferably from about 0.25 to about 8 g/l.

The pH of the developer solution is preferably buffered, e.g., by a phosphate such as potassium hydrogen phosphate ($K_2HPO_4$) or by another phosphate, carbonate, silicate or mixture thereof as buffering agents.

The developer solution has a pH in the range from about 10 to about 12.5, preferably from about 11 to about 12, and more preferably from about 11 to about 11.7.

The invention therefore provides a process comprising a plurality of steps carried out in the same processing equipment in which conventional development and redox development follow each other in any order. There can be a multiple series of steps (i) and (ii) as well, as long as the same order is followed throughout the process.

In one embodiment of this invention, step (i) is carried out before step (ii), and before step (ii), the oxidizing agent in the developing solution is removed or inactivated in a suitable fashion, such as by adding a reducing agent (for example, a sulfite) to the developer solution.

If step (ii) is carried out before step (i), the developer solution does not contain the oxidizing agent when used in step (ii), but it must be added to the developer solution prior to step (i).

Obviously, if a plurality of the series of steps (i) and (ii) are carried out, between each step (i) and (ii), there will be either removal (or inactivation) or addition of the oxidizing agent to the developer solution depending upon which step follows.

The color photographic material to be processed in this invention may be of any type. For example, it may contain relatively low amounts of silver halide or conventional relatively high amounts of silver. Silver halide coverages may be generally in the range of from about 6 to 700 mg/m$^2$. In the case of low silver photographic materials, the coverage is generally from about 10 to about 200, and preferably from about 10 to about 100 mg/m$^2$ (as silver).

The conventional or "relatively high" silver photographic materials generally have a silver coverage greater than about 200 mg/m$^2$ and preferably from about 400 to about 650 mg/m$^2$ (as silver).

A particular application of this invention is in the processing of both low and relatively high silver-containing, silver chloride color papers, for example, color papers comprising at least 89 mol % silver chloride, especially such papers having low silver coverage as defined above.

The photographic materials may comprise the emulsions, sensitizers, couplers, supports, layers, additives, etc. described in *Research Disclosure,* December 1978, Item 17643, published by Kenneth Mason Publications Ltd., Dudley Annex, 12a North Street, Emsworth, Hants P010 7DQ, U.K. The photographic materials can comprise a resin-coated paper support and one or more emulsion layers each having more than 80%, preferably more than 90%, silver chloride, and may be composed of substantially pure silver chloride.

The photographic materials can be single color materials or multicolor materials. Multicolor materials contain dye image-forming units sensitive to each of the three primary regions of the spectrum. Each unit can be comprised of a single emulsion layer or of multiple emulsion layers sensitive to a given region of the spectrum. The layers of the materials, including the layers of the image-forming units, can be arranged in various orders as known in the art.

A typical multicolor photographic material comprises a support bearing a yellow dye image-forming unit comprised of at least one blue-sensitive silver halide emulsion layer having associated therewith at least one yellow dye-forming coupler, and magenta and cyan dye image-forming units comprising at least one green- or red-sensitive silver halide emulsion layer having associated therewith at least one magenta or cyan dye-forming coupler respectively. The material can contain additional layers, such as filter layers.

The process of the invention is particularly suitable for use in a tank of relatively small volume and, in a preferred embodiment, the ratio of the tank volume to maximum area of material accommodatable therein (i.e., maximum path length times width of material) is less than 11 dm$^3$/m$^2$, preferably less than 3 dm$^3$/m$^2$.

The process may be carried out in what is known in the art as a minilab, for example, the tank volume may be below 5 liters, and sometimes below 3.0 liters and preferably in the range of from 1.5 to 2.5 liters, and as low as about 1 liter.

The material to be processed is conveniently passed through the tank and preferably the developer solution is recirculated through the tank at a rate of 0.1 to 10 tank volumes per minute. The recirculation rate is preferably from 0.5 to 8, more preferably from 1 to 5, and most preferably from 2 to 4 tank volumes per minute.

Recirculation, with or without replenishment, may be carried out continuously or intermittently. In one embodiment, both can be carried out continuously while processing is in progress. Replenishment may be carried out by introducing the required amount of replenisher into the recirculation system either inside or outside the processing tank.

The shape and dimensions of the processing tank are preferably such that it holds the minimum amount of processing solution while still obtaining the required results. The tank is preferably one with fixed sides, the material being advanced therethrough by drive rollers. The photographic material passes through a thickness of solution of less than 11 mm, preferably less than 5 mm and more preferably about 2 mm. The shape of the tank is not critical but it may conveniently be in the shape of a shallow tray or U-shaped. It is preferred that the dimensions of the tank be chosen so that the width of the tank is the same as or only just wider than the width of the material being processed.

The total volume of the processing solution within the processing channel and recirculation system is relatively small as compared to prior art processes. In particular, the total amount of processing solution in the entire processing system for a particular module is such that the total volume in the processing channel is at least 40% of the total volume of the processing solution in the entire system. Preferably, the volume of the processing channel is at least about 50% of the total volume of the processing solution in the system.

In order to provide efficient flow of the processing solution through the opening or nozzles into the processing channel, it is desirable that the nozzles/opening that deliver the processing solution to the processing channel have a configuration in accordance with the following relationship:

$$0.6 \leq F/A \leq 23$$

where F is the flow rate of the solution through the nozzle in liters/minute, and A is the cross-sectional area of the nozzle provided in square centimeters.

Providing a nozzle in accordance with the foregoing relationship assures appropriate discharge of the processing solution against the photosensitive material.

Such low volume thin tank processors and systems are described in U.S. Pat. No. 5,294,956; U.S. Pat. No. 5,179,404; U.S. Pat. No. 5,270,762; EP-A-559,025; EP-A-559,026; EP-A-559,027; WO 92/10790; WO 92/17819; WO 93/04404; WO 92/17370; WO 91/19226; WO 91/12567; WO 9207302; WO 93/00612; WO 92/07301; and U.S. Pat. No. 5,436,118.

According to another aspect of the invention there is provided a low volume thin tank system containing a solution which, by the addition or removal of oxidizing agent as appropriate, is suitable for use as a redox developer/amplifier for low silver photographic materials and as a developer solution for conventional silver photographic materials.

The invention is illustrated by the following Examples.

EXAMPLE 1

A color developer solution for conventional relatively high silver color paper had the composition shown in Table 1 below.

TABLE 1

| Component | Amount |
|---|---|
| Sequestrant | 0.8 ml/l |
| $K_2CO_3$ | 25.0 g/l |
| KBr | 0.02 g/l |
| KCl | 2.8 g/l |
| Antioxidant | 5.0 ml/l |
| $K_2SO_3$ (45% w/w) | 0.5 ml/l |
| TEA (100%) | 5.5 ml/l |
| Versa TL-73 | 0.25 ml/l |
| Phorwite REU | 1.0 g/l |
| $Li_2SO_4$ | 2.0 g/l |
| Color developing agent | 4.35 g/l |
| pH | 10.10 |
| Development Time | 45 seconds |
| Development Temperature | 37.8° C. |

The antioxidant was N,N-diethylhydroxylamine as 85% w/w aqueous solution. The sequestrant used in all the examples was a 60% w/w aqueous solution of 1-hydroxyethylidene-1, 1-diphosphonic acid. TEA is triethanolamine. Versa TL is a commercially available surfactant. The color developing agent used in all the examples was N-(2-(4-amino-N-m-toluidino)ethyl)-methanesulfonamide sesquisulfate hydrate. Phorwite REU is an optical brightener.

A redox developer/amplifier solution for processing low silver paper includes hydrogen peroxide but also needs to be further modified from that shown in Table 1 in order to improve the stability of the developer/amplifier solution. The changes are shown in Table 2.

TABLE 2

RX developer/amplifier

| Component | Amount |
|---|---|
| Sequestrant | 0.6 ml/l |
| DTPA | 0.81 g/l |
| $K_2HPO_4 43H_2O$ | 40 g/l |
| KBr | 1 mg/l |
| KCl | 0.5 g/l |
| Hydroxylamine sulfate | 1.0 g/l |
| Color developing agent | 4.5 g/l |
| pH | 11.40 |
| Development Time | 45 seconds |
| Development Temperature | 35° C. |

In order to be able to process both types of color paper in the same developer solution a hybrid solution was needed which satisfies as much as possible the needs of both systems. In order to retain the best stability of the RX developer/amplifier the changes shown in Table 3 were necessary. These include making the changes shown in Table 2, i.e., the antioxidant was changed to hydroxylamine, the buffer to phosphate and the pH to 11.4 and, in addition, including some components which are desirable for the proper development of conventional or high silver color paper. One of these components is a stain reducing agent (Phorwite REU) which is not necessary for the low silver case but is also not detrimental. Other components such as bromide and chloride ions season into the developer solution from the high silver paper and are unavoidable, thus increasing the levels of potassium chloride and potassium bromide.

The developer solution shown in Table 3 was used to process low silver paper in the presence of peroxide, after which the peroxide was removed by adding an equimolar amount of potassium sulfite. The resulting treated developer solution was then used to process conventional or high silver paper.

TABLE 3

RX and Conventional Developer(a).

| Component | Amount |
|---|---|
| Sequestrant | 0.6 ml/l |
| DTPA | 0.81 g/l |
| $K_2HPO_4 3H_2O$ | 40 g/l |
| KBr | 20 mg/l |
| KCl | 2.8 g/l |
| Hydroxylamine Sulfate | 1.0 g/l |
| Color developing agent | 4.5 g/l |
| Phorwite REU | 1.0 g/l |
| pH | 11.40 |
| $H_2O_2$ (30%) | 12.0 ml/l for RX; |
| $HO_2O_2$ (30%) | 0 for conventional |
| Development Time | 45 seconds |
| Development Temperature | 32° C. |

The process cycle used was as follows:

| | |
|---|---|
| Develop or Develop/amplify | 45 seconds |
| KODAK RA-4 Bleach-fix | 45 seconds |
| Wash | 2 minutes |
| Dry | |

Processing was carried out with two different types of color paper. Paper "C" is conventional high silver paper having about 650 mg/m$^2$ of silver, and "RX" is low silver paper having about 120 mg/m$^2$ of silver. The results are shown in Table 4 below.

TABLE 4

| | Densities × 100 | | | | | | | | |
|---|---|---|---|---|---|---|---|---|---|
| | Dmax | | | Dmin | | | Rel. sensitivity | | |
| | R | G | B | R | G | B | R | G | B |
| "C" | 211 | 250 | 186 | 10 | 11 | 9 | 129 | 137 | 127 |
| "RX" | 231 | 252 | 215 | 14 | 17 | 19 | 104 | 110 | 116 |

It can be seen that the "RX" paper exhibited a higher Dmin density than the "C" paper. This is known to be due to iron catalyzed oxidation of color developing agent by peroxide in the bleach-fix.

This Dmin can be prevented if the process cycle is changed to include a stop bath after the developer bath as follows:

| | |
|---|---|
| Develop or Develop/amplify | 45 seconds |
| Stop | 30 seconds |
| KODAK RA-4 bleach-fix | 45 seconds |
| Wash | 2 minutes |
| Dry | |

The stop bath was a solution of 20 g/l of sodium metabisulfite

TABLE 5

| | Densities × 100 | | | | | | | | |
|---|---|---|---|---|---|---|---|---|---|
| | Dmax | | | Dmin | | | Rel. sensitivity | | |
| | R | G | B | R | G | B | R | G | B |
| "C" | 208 | 248 | 186 | 9 | 10 | 9 | 127 | 134 | 121 |
| "RX" | 230 | 249 | 213 | 9 | 10 | 8 | 106 | 109 | 114 |

The Dmin of the "RX" paper was now the same as that in the "C" paper.

EXAMPLE 2

In this Example the composition of the developer solution was changed slightly by lowering the HAS level to 0.6 g/l. This had the effect of raising the activity for both types of paper. The composition of this developer solution is shown in Table 6.

TABLE 6

| RX and conventional developer(b) | |
|---|---|
| Component | Amount |
| Sequestrant | 0.6 ml/l |
| DTPA | 0.81 g/l |
| $K_2HPO_43H_2O$ | 40 g/l |
| KBr | 20 mg/l |
| KCl | 2.8 g/l (2.5 g/l added as 0.3 g/l is from REU) |
| Hydroxylamine sulfate | 0.6 g/l |
| Color developing agent | 4.5 g/l |
| Phorwite REU | 1.0 g/l |
| pH | 11.40 |
| $H_2O_2$ (30%) | 9.0 ml/l for RX; |
| $H_2O_2$ (30%) | 0 for conventional |
| Development Time | 45 seconds |
| Development Temperature | 32° C. |

A comparison between two "RX" processed samples of low silver paper shows "RX3" which goes into RA-bleach-fix plus 50 g/l sodium sulfite and "RX4" where 100 g/l of sodium sulfite was added to RA-4 bleach-fix.

The results are shown in Table 7.

TABLE 7

| Conventional and low silver paper | | | | | | |
|---|---|---|---|---|---|---|
| | Densities × 100 | | | | | |
| | Dmax | | | Dmin | | |
| | R | G | B | R | G | B |
| "C3" | 244 | 262 | 219 | 9 | 10 | 9 |
| "C4" | 254 | 260 | 226 | 9 | 10 | 9 |
| "RX3" | 256 | 250 | 207 | 9 | 14 | 17 |
| "RX4" | 259 | 252 | 218 | 10 | 12 | 10 |

Where the process was as follows:

| | |
|---|---|
| Develop or Develop/amplify | 45 seconds |
| KODAK RA-4 Bleach-fix + Sulfite | 45 seconds |
| Wash | 2 minutes |
| Dry | |

"C3" was high silver paper/no peroxide/RA-4 bleach-fix +50 g/l sodium sulfite.

"C4" was high silver paper/no peroxide/RA-4 bleach-fix+ 100 g/l sodium sulfite

"RX3" was low silver paper/peroxide/RA-4 bleach-fix+50 g/l sodium sulfite

"RX4" was low silver paper/peroxide/RA-4 bleach-fix+ 100 g/l sodium sulfite.

It can be seen that the performances of the two paper types were similar. In particular the addition of sodium sulfite (100 g/l) to RA-4 bleach fix lowered the Dmin of the "RX" processed paper to an acceptable level.

The process was repeated with a stop-bath and with a standard RA-4 bleach-fix as outlined in Example 1 so that the process cycle was as follows:

| | |
|---|---|
| Develop or Develop/amplify | 45 seconds |
| Stop | 30 seconds |
| RA-4 Bleach Fix | 45 seconds |
| Wash | 2 minutes |
| Dry | |

The results are shown in Table 8.

TABLE 8

| | Densities × 100 | | | | | |
|---|---|---|---|---|---|---|
| | Dmax | | | Dmin | | |
| | R | G | B | R | G | B |
| "C5" | 247 | 255 | 216 | 9 | 10 | 9 |
| "RX5" | 253 | 249 | 211 | 9 | 10 | 8 |

It can be seen that the Dmin for the "RX" paper and the "C5" paper are almost the same. By this means, both types of developer can be run in the same basic process except that the hydrogen peroxide in the developer bath is added for the "RX" process or removed with sulfite for the conventional process.

The invention has been described in detail with particular reference to certain preferred embodiments thereof, but it will be understood that variations and modifications can be effected within the spirit and scope of the invention.

We claim:

1. A process for the sequential color development, in the same processor, of an imagewise exposed low silver photographic material and an imagewise exposed relatively high silver photographic material, said method comprising, in any order:

(i) developing said low silver photographic material in a developer solution comprising a color developing agent, and a buffering agent, and having a pH in the range of from 10 to 12.5, and (ii) developing said relatively high silver photographic material with said developer solution, provided that when step (i) is carried out, said developer solution further comprises an oxidizing agent to make said developer solution a redox developer/amplifier solution, and further provided that when step (i) is carried out first, said developer solution is treated to remove said oxidizing agent, and when step (ii) is carried out first, said oxidizing agent is added to said developer solution prior to step (i).

2. The process of claim 1 wherein step (i) is carried out before step (ii).

3. The process of claim 1 wherein step (ii) is carried out before step (i).

4. The process of claim 1 wherein said oxidizing agent is a peroxide or a compound that provides peroxide.

5. The process of claim 1 wherein said developer solution further comprises an antioxidant.

6. The process of claim 5 wherein said antioxidant is a hydroxylamine or derivative thereof.

7. The process of claim 4 wherein said peroxide is present in an amount of from 0.5 to 30 ml/l (as 30% w/w aqueous solution).

8. The process of claim 5 wherein said antioxidant is present in an amount of from 0.01 to 20 g/l.

9. The process of claim 8 wherein said antioxidant is present in an amount of from 0.25 to 8 g/l.

10. The process of claim 1 wherein said buffering agent is a phosphate.

11. The process of claim 1 wherein said oxidizing agent is removed by the addition of a reducing agent to said solution.

12. The process of claim 11 wherein said reducing agent is a sulfite.

13. The process of claim 1 wherein said developer solution further comprises a stain reducing agent.

14. The process of claim 1 carried out in a low volume developer tank processor.

15. The process of claim 1 further comprising a stop bath after steps (i) and (ii).

16. The process of claim 1 wherein said lower silver photographic material has a silver coverage of up to about 200 mg/m2.

17. The process of claim 16 wherein said low silver photographic material has a silver coverage of from about 10 to about 100 mg/m2.

18. The process of claim 1 wherein said relatively high silver photographic material has a silver coverage of more than 200 mg/m2.

19. The process of claim 1 wherein both low and relatively high photographic materials are color photographic papers having an at least 80% mol % silver chloride emulsion.

* * * * *